US005294118A

United States Patent [19]

Iwanaga

[11] Patent Number: 5,294,118

[45] Date of Patent: Mar. 15, 1994

[54] GOLF CLUB SHAFT

[75] Inventor: Takeshi Iwanaga, Kobe, Japan

[73] Assignee: Sumitomo Rubber Industries, Ltd., Kobe, Japan

[21] Appl. No.: 868,526

[22] Filed: Apr. 15, 1992

[30] Foreign Application Priority Data

Apr. 16, 1991 [JP] Japan ..... 3-112529

[51] Int. Cl.[5] ..... A63B 53/12

[52] U.S. Cl. ..... 273/80 A; 273/80 B; 273/81 A

[58] Field of Search ..... 273/81 R, 81 A, 80 R, 273/80 B, 77 R, 77 A, 170, 75, 80 A

[56] References Cited

U.S. PATENT DOCUMENTS

| | | | |
|---|---|---|---|
| 391,994 | 10/1888 | Flotow et al. | 273/80 R |
| 3,075,768 | 1/1963 | Karns | 273/81 A |
| 3,871,649 | 3/1975 | Kilshaw | 273/77 A |
| 4,058,312 | 11/1977 | Stuff et al. | 273/80 A X |
| 4,123,055 | 10/1978 | Brill | 273/80 B X |
| 4,125,260 | 11/1978 | Kanne et al. | 273/80 R |
| 4,214,395 | 7/1980 | Caldwell | 273/80 B X |
| 4,415,156 | 11/1983 | Jorgensen | 273/81 A X |
| 4,461,479 | 7/1984 | Mitchell | 273/77 A X |
| 4,690,407 | 9/1987 | Reisner | 273/80 A X |
| 5,083,780 | 1/1992 | Walton et al. | 273/80 B |

FOREIGN PATENT DOCUMENTS

| | | | |
|---|---|---|---|
| 0294107 | 12/1988 | European Pat. Off. | 273/80 A |
| 13337 | of 1912 | United Kingdom | 273/81 A |
| 2040693 | 9/1980 | United Kingdom | 273/80 B |
| 2053004 | 2/1981 | United Kingdom | 273/80 B |
| 2227418 | 8/1990 | United Kingdom | 273/77 A |
| 8301578 | 5/1983 | World Int. Prop. O. | 273/77 R |

*Primary Examiner*—Vincent Millin
*Assistant Examiner*—Sebastiano Passaniti
*Attorney, Agent, or Firm*—Armstrong, Westerman, Hattori, McLeland & Naughton

[57] ABSTRACT

A metallic inner pipe for the positional adjustment of the gravitational center is inserted in a metallic shaft body from a large-diameter end aperture thereof, and this inner pipe is secured in a large-diameter end portion of the metallic shaft body. This metallic inner pipe is located in an internal area of the shaft body which ranges between 0 mm and 350 mm from the large-diameter extremety of the shaft body, while on the other hand, the metallic inner pipe is 50 mm to 350 mm in the length thereof, and is 10 g to 50 g in the weight thereof. The inner pipe is secured to the large-diameter end portion of the metallic shaft body by using adhesives or any other suitable fixing means. If the inner pipe is secured to the metallic shaft body, the outside end of the metallic inner pipe is aligned with the large-diameter end of the metallic shaft body.

1 Claim, 3 Drawing Sheets

GOLF CLUB SHAFT

BACKGROUND AND SUMMARY OF THE INVENTION

The present invention relates to improved golf club shafts.

In general, conventional metallic golf club shafts comprise their body portions which are formed in a stepped configuration by cold-drawing a tubular chrome molybdenum steel material of wall thickness equal or even in any portion thereof. The gravitational centers of such conventional golf club shafts are located in a position ranging between 50% and 54% of their overall length from their ends of small diameter in terms of values obtained by dividing by the overall length the distance from such ends to the positions of the gravitational centers.

What is called the swing balance or the swing weight of the golf club is the turning moment around a constant point on the club shaft which is located 355.6 mm (14 inches) inwardly from the grip end of the golf club. In a plurality of golf clubs which are all equal in the values of their turning moments thus identified as the swing balance or the swing weight, one or those in which the positions of the gravitational centers are nearer located to the large-diameter side end, namely, the grip end of the club can be still more increased in their head weight.

However, in the foregoing conventional type golf club shafts, it was difficult from the viewpoints of their construction to locate the positions of their gravitational centers so as to be nearer to their largest-diameter ends. For this reason, in order to allow the positions of the gravitational centers to be located nearer to the shaft ends of large diameter, integrally formed golf club shafts as described and shown in, for example, U.S. Pat. No. 3,871,649 and U.K. Patent Application GB 2227418A were constructed such that their large-diameter side end portions are increased in their wall thickness as compared with their small diameter side end portions.

However, if a tubular material of wall thickness equal or even in any portion thereof is cold-drawn into a golf club shaft, the large-diameter side end portion thereof is inevitably thinner in the wall thickness thereof than the small-diameter side end portion thereof.

Under the circumstances, it becomes necessary to use as a shaft manufacturing material a special tube in which the wall thickness thereof is the greatest in an end portion thereof to be formed into a large-diameter side end portion, and is gradually reduced towards the other end portion thereof. Also, an applicable cold-drawing operation is required to form the special material tube into a golf club shaft in which the wall thickness thereof is greater in the large-diameter side end portion thereof and is small in the small-diameter side end portion thereof than in the conventional golf club shafts. This special manufacturing method causes the manufacturing process to be complicated, thereby increasing the manufacuring cost. This is a disadvantage of the special manufacturing method.

It is therefore a primary object of the present invention to provide for an improved metallic golf club shaft in which the position of the gravitational center is located nearer to the large-diameter end portion than in the conventional golf club shafts by using a simple manufacturing process.

Also, it is a second object of the present invention to provide for an improved golf club shaft in which the weight of the head thereof is increased as compared with the conventional golf club shafts while the swing balance thereof remains identical with that of the conventional golf club shafts.

BRIEF DESCRIPTION OF THE DRAWINGS

The present invention will be described with reference to the accompanying drawings, in which.

DETAILED DESCRIPTION OF THE PREFERRED EMBODIMENTS

The first preferred embodiment of the golf club shaft according to the present invention will now be described with reference to FIGS. 1 to 3. A golf club shaft S illustrated in FIG. 3 in which an overall side posture thereof is best shown comprises a metallic shaft body 1, and a metallic inner pipe 3 inserted and secured in a large-diameter end portion 2 of the shaft body 1.

Figure 3:
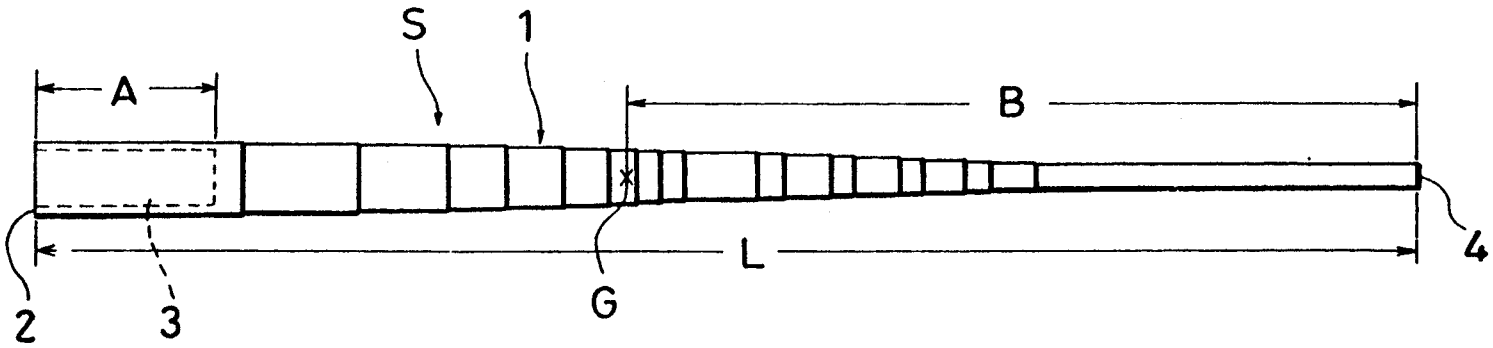
FIG. 3 is an overall side view of the golf club shaft of FIG. 1.

The metallic shaft body 1 is formed in a stepped configuration in which it is provided with a plurality of steps as shown in FIG. 3, by cold-drawing a tubular chrome molybdenum steel material or other similar tubular materials.

The metallic inner pipe 3 functions to adjust the position of the gravitational center of the club shaft. This metallic inner pipe 3 is inserted and secured in the large-diameter end portion of the shaft body 1, and the depth at which the inner pipe 3 is inserted in the large-diameter end portion of the shaft body 1 ranges between 0 mm and 350 mm. This depth is shown at A in FIGS. 1 and 2. As a result, any portion of the inner pipe 3 does not exist 350 mm or above from the large-diameter extremety of the shaft body 1.

On the other hand, the pipe 3 inserted in the shaft body 1 to adjust the position of the graviational center of the entire gold club shaft body is 50 mm to 350 mm in the length A thereof, while at the same time, the weight of the pipe ranges between 10 g and 50 g. FIG. 1 shows that the outside end 7 of the pipe 3 is brought into coincidence with the large-diameter end 2 of the shaft body 1.

The pipe 3 is fixed in the large-diameter end portion of the shaft body 1 by means of adhesives after being inserted thereinto. The use of caulking, force fit or other suitable means is feasible for the fixation of the inner pipe 3 in the shaft body 1.

Moreover, the gravitational center of the shaft body 1 is desired to be located in a position expressed in terms of percentage given by the following formula.

$$56\% \leqq (B-L) \times 100 \leqq 65\%$$

in which, L is the overall length of the shaft body 1;

B is the distance from the small diameter end 4 to the position of the gravitational center.

Figure 1:
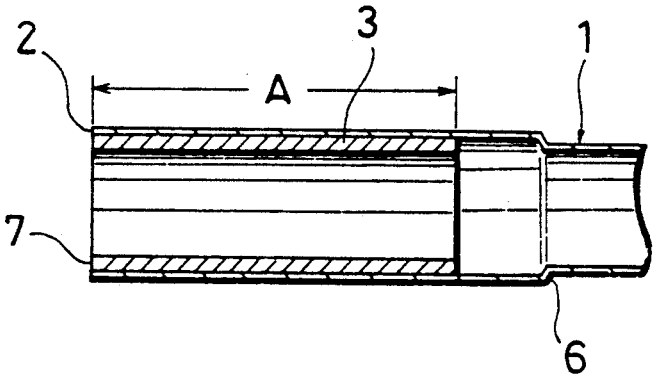
FIG. 1 is an enlarged sectional view of a principal portion of a golf club shaft according to a first preferred embodiment of the present invention.

In the first preferred embodiment of the present invention which is shown in FIGS. 1 and 3, the metallic inner pipe 3 is straight in the shape thereof. With respect to the shaft body 1 which does not have this straight metallic inner pipe 3 inserted therein, the following Table 1 lists the values of the dimensions B and L as defined in the foregoing, the weight of the shaft body and the percentage showing the position of the gravitational center.

TABLE 1

| Overall Length of Shaft Body (L) | Weight of Shaft Body | Distance from Small-Diameter End to Position of Gravitational Center (B) | B/L × 100 |
|---|---|---|---|
| 1143 mm | 123 g | 609.5 mm | 53.3% |

As shown in FIG. 1, a straight metallic pipe 3 of 300 mm in length A and 22.5 g in weight is inserted and secured in the shaft body 1 of the specifications given in the foregoing Table 1, to thereby form a golf shaft S. In connection with this golf club shaft S, the following Table 2 lists the values of the dimensions B and L, the weight of the shaft body and the percentage value showing the position of the gravitational center.

TABLE 2

| Overall Length of Shaft Body (L) | Weight of Shaft Body | Distance from Small-Diameter End to Position of Gravitational Center (B) | B/L × 100 |
|---|---|---|---|
| 1143 mm | 145.5 g | 669.0 mm | 58.5% |

The shaft body 1 as specified in Table 1 also has another straight metallic inner pipe 3 inserted therein, as shown in FIG. 1 to thereby form a second golf club shft S. This inner pipe 3 is 200 mm in the length A thereof and 22.5 g in weight. The second golf club shaft thus obtained posseses the dimensions B and L, the shaft body weight and the percentage value showing the position of the gravitational center as listed in the following Table 3.

TABLE 3

| Overall Length of Shaft Body (L) | Weight of Shaft Body | Distance from Small-Diameter End to Position of Gravitational Center (B) | B/L × 100 |
|---|---|---|---|
| 1143 mm | 145.5 g | 676.5 mm | 59.2% |

As is apparent from Tables 2 and 3, if the metallic inner pipe 3 inserted and secured in the shaft body 1 for the positional adjustment of the gravitational center thereof is heavier in weight and small in length, this inner pipe 3 causes the gravitational center to be still more moved along the shaft body 1. That is to say, the percentage value representing the position of the gravitational center, which is given by the foregoing formula B/L×100 is still greater if the metallic inner pipe 3 has heavier weight and small length.

The swing balance or swing weight is generally used as the index of easy swingability of the golf club shaft. This swing balance or swing weight is expressed in terms of the value of the turning moment around the constant point on the club shaft which is located usually 355.6 mm (14 inches) inwardly from the large-diameter end of the golf club shaft. Therefore, if the metallic inner pipe 3 is more than 350 mm in the length A thereof, movement of the gravitational center produces almost no effect upon the swing weight. Also, if the length A of the metallic inner pipe 3 exceeds 355.6 mm, it impairs any improvement in the swing balance, because the inner pipe 3 extends over the reference point for the calculation of the turning moment.

In contrast with this, if the metallic inner pipe 3 is less than 50 mm in the length A thereof, there is the risk that the securablity or fixability thereof to the inner circumferential surface of the shaft body 1 is decreased as a result of reduction in the contact area of the inner pipe 3 with the shaft body 1, whereby the inner pipe 3 may be detached from the position within the shaft body at which it is secured to the shaft body 1, and may be moved through the shaft body.

The second preferred embodiment of the present invention will now be described with reference to FIG. 2.

The metallic inner pipe 3 for the positional adjustment of the gravitational center is formed in a stepped configuration, and includes a raised portion 5. This raised portion 5 is brought into conincidence with a mating raised portion 6 of the shaft body 1, and also, an outside end 7 of the pipe 3 is aligned with the large diameter end 2 of the shaft body 1.

Figure 2:
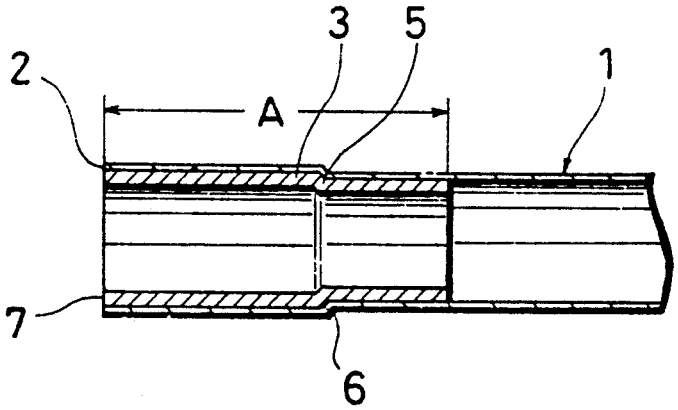
FIG. 2 is an enlarged sectional view of a principal portion of a golf club shaft according to a second preferred embodiment of the present invention.

Moreover, the inner pipe 3 is formed such that the outer circumferential surface thereof has the substantially same shape and size as the inner circumferential surface of the shaft body 1, as shown in FIG. 2. This achieves the snug fit and firm fixation of the inner pipe 3 in the shaft body 1, and also prevents the detachment of the inner pipe from the internal position of the shaft body at which it is secured to the shaft body 1.

Preferably, the inner pipe 3 is provided with a plurality of raised portions 5, and the shaft body is also formed with a plurality of raised portions 6 which correspond in position and number to the raised portions 5 of the inner pipe 3, to thereby bring the raised portions 6 of the inner pipe 5 into engagement with the raised portions 6 of the shaft body 1, with the inner pipe 3 inserted in the shaft body 1 (not shown).

In the first and second preferred embodiments of the present invention, the outside end 7 of the inner pipe 3 is aligned with the large-diameter end 2 of the shaft body 1 as illustrated in FIGS. 1 to 3. However, it is to be noted that these both ends 2 and 7 are allowed to have some misalignment with each other.

Figure 4:
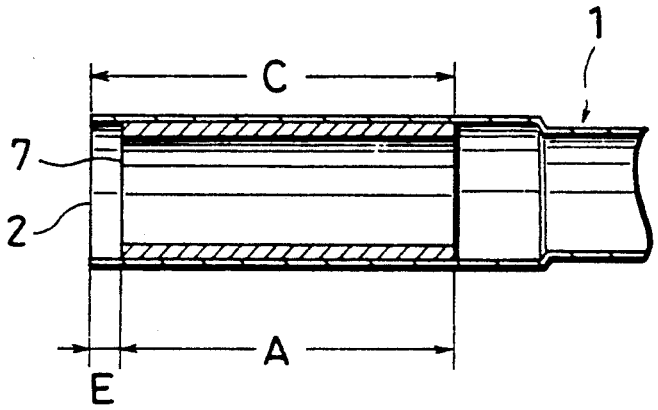
FIG. 4 is an enlarged sectional view of a principal portion of a golf club shaft according to a third preferred embodiment of the present invention.
Figure 5:
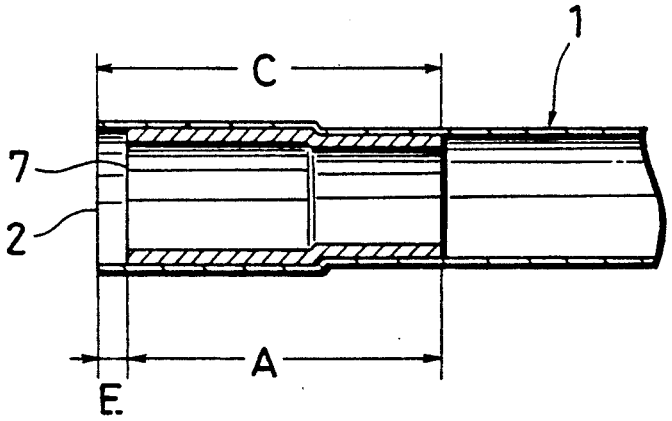
FIG. 5 is an enlarged sectional view of a principal portion of a golf club shaft according to a fourth preferred embodiment of the present invention.

In the third and fourth preferred embodiments of the present invention, the outside ends 7 of the inner pipes 3 for the positional adjustments of the gravitational centers are located nearer to the small-diameter end of the shaft body 1 by the length E, as illustrated in FIGS. 4 and 5. In this case, the inner pipe 3 is located in an area of the shaft body which ranges between several millimeters and 350 mm from the large-diameter end of the shaft body 1, while at the same time, the inner pipe 3 is 50 mm to 350 mm in the length A thereof.

As already described in the foregoing, the swing balance or the swing weight of the golf club, which is generally employed as the index of easy swingability thereof is the value of the turning moment around a constant point on the club shaft which is located usually 355.6 mm (14 inches) inwardly from the grip end thereof, with the club horizontally supported. The value of this swing balance remains unchanged even if the club head is increased in the weight thereof. Therefore, if a golf club locates the gravitational center of the shaft thereof nearer to the large-diameter end of the shaft, namely, the grip end of the shaft, with the foregoing turning moment value thereof unchanged, the head of this golf club is still more enhanced in the weight thereof. In this case, the increase in the weight of the head does not alter the value of the swing balance. For this reason, the head speed of this golf club remains undiminished, and this golf club allows an increase in the flying speed and flying distance of a golf ball hit thereby by the increase of the weight of the club head.

In order to increase the weight of the club head, the gravitationl center of the club shaft has only to be brought nearer to the large-diameter end, or the grip end thereof.

In the golf club shafts according to the present invention, the positions of the gravitational centers are allowed to be approximately 56% to approximately 65% from their small-diameter ends as calculated by the foregoing formula $B/L \times 100$, while on the other hand, the conventional golf club shafts have the gravitational centers located from 50% to 54% as expressed by the calculating formula. This is a considerable approach of the gravitational centers to the large-diameter ends of the club shafts according to the present invention.

Thus, as is apparent from the foregoing, if the golf clubs comprising the club shafts according to the present invention are increased in the weight of their heads, the golf clubs present their superior properties in which the flying speeds and flying distances of golf balls hit by them are enhanced in proportion to the weight increase in their heads while their swing balance and head speeds remain unchanged.

In order to manufacture the golf club shafts of the present invention, the metallic inner pipes 3 for the positional adjustments of the garavitational centers are only inserted and secured in the shaft bodies 1 which are manufactured in the same manner as the conventional golf club shafts. Therefore, the golf club shafts of the present invention are easy to manufacture at a low cost. This is also an advantage of the present invention.

While in the foregoing specification, a detailed description of specific embodiments of the present invention was set forth for the purpose of illustration, it will be understood that many of the details herein given may be varied considerably by those skilled in the art without departing from the spirit and scope of the invention.

I claim:

1. A golf club shaft comprising a metallic inner pipe having a length in the range of 50 mm to 350 mm and a weight in the range of 10 g to 50 g, and a metallic shaft body having a large diameter end and a small diameter end with a gravitational center located between said large and small diameter ends, the metallic inner pipe being inserted into the metallic shaft body from the large-diameter end thereof for positional adjustment of the gravitational center of the golf club shaft, the metallic inner pipe being secured in an internal area of the metallic shaft body which ranges between 0 mm and 350 mm as measured from the large diameter end of the metallic shaft body so that the gravitational center of said golf club shaft is located in a position ranging between 56% and 65% from the small diameter end of the metallic shaft body as calculated by the formula $B/L \times 100$, in which B is the distance from the small diameter end of the metallic shaft body to the position of the gravitational center of the shaft body and L is the overall length of the metallic shaft body.

* * * * *